US005517835A

United States Patent [19]

Smith

[11] Patent Number: 5,517,835

[45] Date of Patent: May 21, 1996

[54] CABLE LOCKING DEVICE

[76] Inventor: Allen Smith, 18 Swift Ct., Newport Beach, Calif. 92663

[21] Appl. No.: 303,417

[22] Filed: Sep. 9, 1994

[51] Int. Cl.[6] ..... E05B 73/00

[52] U.S. Cl. ..... 70/14; 70/18; 70/49; 70/58

[58] Field of Search ..... 70/18, 30, 49, 70/14, 15, 58, 233, 259, 260, 16, 17, 53, 38 A

[56] References Cited

U.S. PATENT DOCUMENTS

| | | | |
|---|---|---|---|
| 351,063 | 10/1886 | McCormick . | |
| 539,650 | 5/1895 | Searle | 70/15 |
| 548,318 | 10/1895 | Koch | 70/49 |
| 866,965 | 9/1907 | Redding | 70/49 |
| 2,623,378 | 12/1952 | Haver . | |
| 2,631,449 | 3/1953 | Protsman | 70/457 |
| 3,518,853 | 7/1970 | Bolte . | |
| 3,585,823 | 6/1971 | Nagel | 70/49 |
| 3,623,378 | 11/1971 | Stanford . | |
| 4,070,879 | 1/1978 | Thompson | 70/20 |
| 4,854,138 | 8/1989 | Charland | 70/30 X |
| 5,359,870 | 11/1994 | Reutlinger | 70/456 R |

FOREIGN PATENT DOCUMENTS

| | | | |
|---|---|---|---|
| 158119 | 2/1905 | Germany | 70/18 |
| 839169 | 5/1952 | Germany | 70/49 |
| 10794 | 5/1902 | Norway | 70/49 |
| 213 | of 1879 | United Kingdom | 70/49 |
| 617978 | 2/1949 | United Kingdom | 70/49 |
| 1538021 | 1/1979 | United Kingdom | 70/49 |
| 2240578 | 8/1991 | United Kingdom | 70/49 |

*Primary Examiner*—Lloyd A. Gall
*Attorney, Agent, or Firm*—Harvey C. Nienow

[57] ABSTRACT

A locking mechanism for providing one or more loops in a cable for separately encircling and retaining different objects wherein different cable portions are gripped by the locking mechanism merely by an individual squeezing the housing of the mechanism to cause wedge-shaped elements to engage the respective cable portions.

8 Claims, 1 Drawing Sheet

CABLE LOCKING DEVICE

The present invention relates generally to locking devices, but more particularly to locking mechanisms which employ a cable which is capable of being formed into two or more loops so as to encircle and retain two or more different objects. More specifically, it relates to locking mechanisms which are quickly and easily locked or set but which can only be released or opened with the use of a key.

BACKGROUND OF THE INVENTION

It is frequently desirable to be able to fasten or mount a given object, such as sports implements like golf clubs or tennis paraphernalia, to a support such as a stationary post to prevent the same from being lost or stolen. To facilitate this, it is desirable to have fastening or locking mechanisms which can be expanded to accommodate articles or objects of different sizes. Also, it is desirable to have such mechanism be small and compact so as to be easily transported and stored, as desired.

Devices of this nature have heretofore been provided, but all such prior devices fall short of the necessary construction and operation to provide the desired end result.

Devices heretofore provided for use in this general security area have been extremely large in size and have been cumbersome and awkward in usage under certain circumstances. Further, they have been relatively large such that transporting and storing such devices has been difficult and awkward.

OBJECTS OF THE INVENTION

In view of the foregoing, it is an object of the present invention to provide a locking mechanism which is capable of providing two or more loops in a cable whereby a plurality of different objects can be encircled and retained in connected relation.

Another object of the present invention is to provide a locking mechanism as characterized above which can be quickly actuated to firmly grip a cable at several specific locations therealong, but which can be quickly released so as to free the objects retained thereby.

Another object of the present invention is to provide a locking mechanism as characterized above which employs two or more wedge-shaped elements which effectively cooperate to grip the cable along its length at several predetermined locations.

A still further object of the present invention is to provide a locking mechanism as characterized above which can be set or caused to firmly grip a cable merely by a human operator giving a slight squeeze to a housing.

An even further object of the present invention is to provide a locking mechanism as characterized above wherein a spring loaded lever is caused to automatically engage and retain the wedge-shaped elements after the human operator has lightly squeezed the housing.

Another even still further object of the present invention is to provide a locking mechanism as characterized above wherein a key operated device is employed for releasing such lever so as to permit the wedge-shaped elements to return to a retracted position releasing the cable.

Another object of the present invention is to provide a locking mechanism as characterized above which is simple and inexpensive to manufacture and which is rugged and dependable in operation.

BRIEF DESCRIPTION OF THE DRAWINGS

The novel features which I consider characteristic of my invention are set forth with particularity in the appended claims. The invention itself, however, both as to its organization and mode of operation, together with additional objects and advantages thereof, will best be understood from the following description of specific embodiments when read in combination with the accompanying drawings, in which:

Like reference characters indicate corresponding parts throughout the several views of the drawings.

DESCRIPTION OF THE PREFERRED EMBODIMENT

Figure 1:
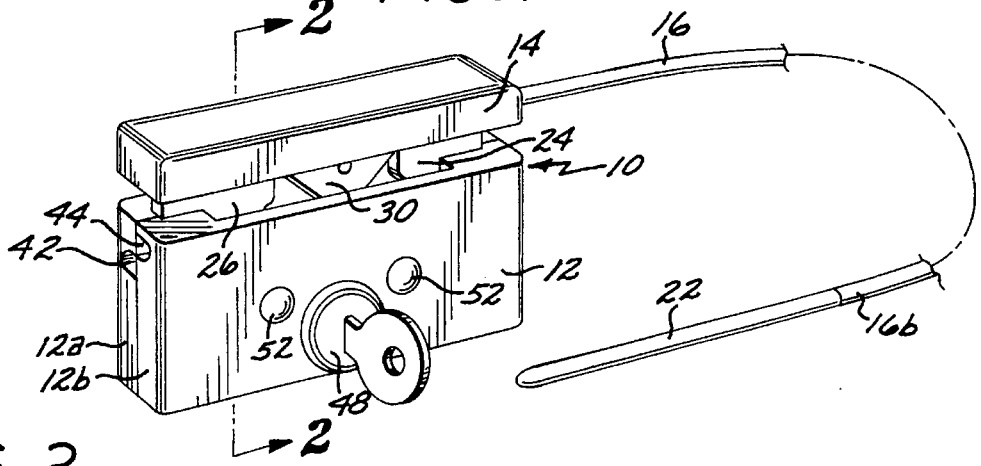
FIG. 1 is a perspective view of a locking mechanism according to the present invention.

Referring to FIG. 1 of the drawings, there is shown therein a locking mechanism 10 according to the present invention. It comprises a body or housing 12 having a cover 14, and a flexible cable 16. One end 16*a* of cable 16 is secured within the cover 14 of housing 12.

Figure 3:
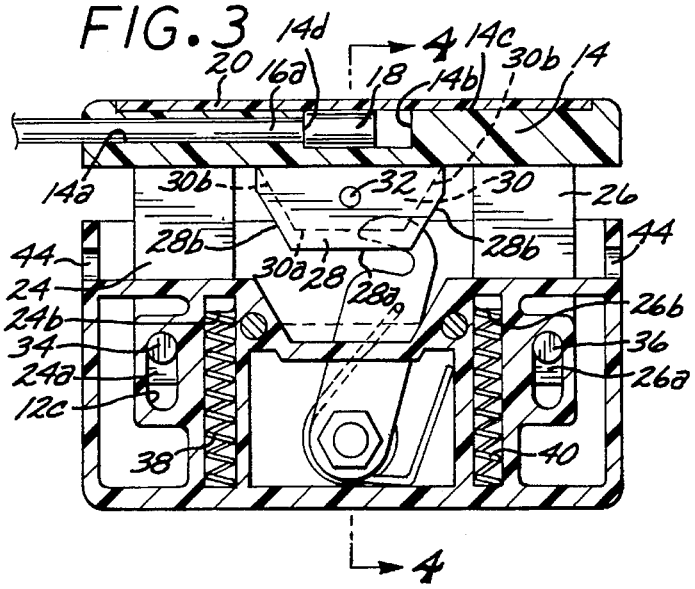
FIG. 3 is a sectional view of the locking mechanism taken substantially along line 3—3 of FIG. 2.
Figure 4:
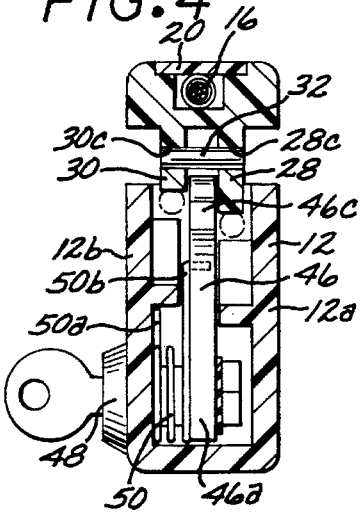
FIG. 4 is a sectional view of the mechanism taken substantially along line 4—4 of FIG. 3.

As shown most particularly in FIGS. 3 and 4 of the drawings, the cover 14 is formed with an opening 14*a* for receiving end 16*a* of cable 16. Cover 14 is further formed with an enlarged opening 14*b*, and a large recess 14*c* which extends substantially the entire length and width of cover 14.

As will be readily apparent to those persons skilled in the art, the body or housing 12, including cover 14, may be formed of substantially any desired material, but is deemed best made of tough, unbreakable plastic material. Such housing and cover therefore may be formed in a machining process or they may be cast or molded to provide the desired shapes and configurations as will hereinafter become more apparent.

A ferrule 18 is firmly secured to the end 16*a* of cable 16 after the latter has been inserted in opening 14*a*. Thus, ferrule 18 is cause to be able to abut the annular shoulder 14*d* formed in cover 14 between the openings 14*a* and 14*b*. Plastic or other appropriate material 20 is provided to close the recess 14*c* in the upper portion of cover 14, end portion 16*a* of cable 16 thereby being firmly secured and anchored in the cover 14.

The opposite end 16*b* of cable 16 is provided with a generally tapered and generally semi-rigid leader 22 to facilitate insertion of end portion 16*b* as will hereinafter be explained in greater detail.

Attached to or formed integrally with cover 14 are a pair of alignment members 24 and 26, each of which is formed with an end portion of reduced size, as shown at 24*a* and 26*a*, to thereby provide shoulders 24*b* and 26*b*, respectively.

Also formed integrally with cover 14 is a pair of wedge-shaped elements 28 and 30. Wedge-shaped element 28 is formed with a bottom wall 28*a* and slanted opposite side walls 28*b*. Element 30 is formed with a bottom wall 30*a* and slanted opposite side walls 30*b*. As shown most particularly in FIG. 4 of the drawings each of the wedge-shaped elements 28 and 30 is formed with a through opening as shown at 28*c* and 30*c*, which holes are aligned so as to receive a pin 32.

Figure 2:
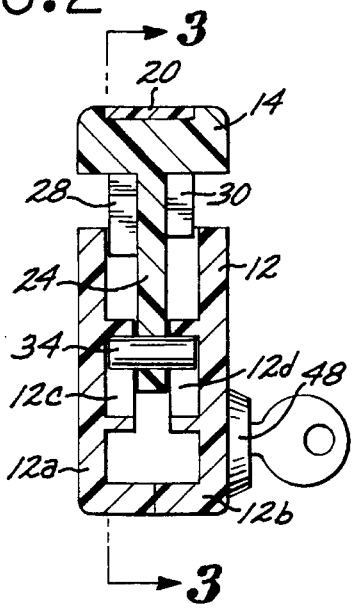
FIG. 2 is a sectional view taken substantially along line 2—2 of FIG. 1 of the drawings.

The body 12 of locking mechanism 10 is formed by a molding or casting process in two halves 12*a* and 12*b*. It is deemed preferable to form such body 12 of hard non-breakable plastic to ensure the integrity of the locking mechanism 10. As shown in the drawings, the lower portions 24*a* and 26*a* of the guide members 24 and 26 are formed with through openings for receiving guide pins 34 and 36 respectively. These guide pins have opposite end portions which move within elongated recesses formed in housing 12 as shown in FIG. 2 at 12*c* and 12*d* with respect to pin 34. Compression springs 38 and 40 are positioned between the bottom wall of housing 12 and the shoulders 24*b* and 26*b*, respectively, of the guide members 24 and 26. Thus, the compression spring 38 operates against the shoulder 24*b* of guide member 24 and the compression spring 40 operates against the shoulder 26*b* of guide member 26. As will be readily apparent to those persons skilled in the art, this enables the guide members 24 and 26 together with the cover 14 and wedge-shaped elements 28 and 30 to be biased to an open or retracted position as shown in FIG. 3.

Housing 12 is also formed with aligned through openings in its opposite end walls to form two generally parallel passageways as shown at 42 and 44 in FIG. 1. Such passageways are aligned with the wedge-shaped elements 28 and 30, respectively, for purposes which will hereinafter be explained in greater detail.

Positioned centrally within the body or housing 12 is a lever 46. One end 46*a* of lever 46 is formed with a through opening for receiving a key operated locking mechanism 48 which is mounted within a through opening in one of the walls of the housing 12. The other end 46*b* of lever 46 is formed with a cutout 46*c* which, as will hereinafter be explained in greater detail, cooperates with the aforementioned pin 32 which extends between the elements 28 and 30 as shown most particularly in FIG. 4 of the drawings. A torsion spring 50 is provided and has one end portion 50*a* engaging the housing 12. The opposite end 50*b* of torsion spring 50 engages lever 46 to thereby bias lever 46 toward engagement of cutout 46*c* with pin 32.

Fastening means in the form of rivets or bolts 52 are provided to retain the two halves 12*a* and 12*b* of the housing 12 in assembled relation as above described.

When it is desired to employ the subject locking mechanism 10, it is merely necessary to encircle an object with the cable 16, and thereafter to thread the leader 22 through one of the aforementioned passageways 42 and 44. Thereafter, the cable can be drawn firmly about such object and thereafter caused to encircle an additional object. Then, the cable 16 can be inserted through the remaining one of the passages 42 and 44 so as to cause the cable 16 to be drawn firmly about such additional object.

Figure 5:
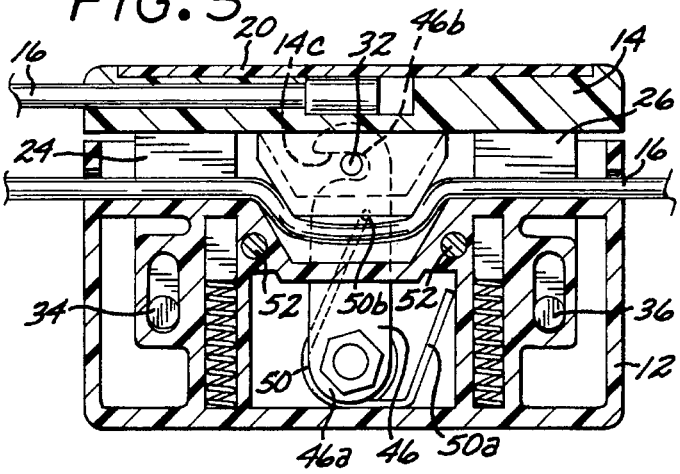
FIG. 5 is a sectional view similar to that of FIG. 3 of the drawings, but showing the mechanism in its locked or cable gripping position.

Then, merely by gripping the housing and cover 14 in the palm of a person's hand, the cover is moved toward the housing to drive the wedge-shaped elements 28 and 30 toward the respective cable portions to the position shown in FIG. 5 of the drawings. When the elements 28 and 30 sufficiently engage the respective cable portions, the torsion spring 50 moves the end portion 46*b* of lever 46 to the position shown in FIG. 5 thereby locking such elements against the cable. That is, the housing 12 is thereby firmly and fixedly secured to the cable 16 to retain the several objects in fixed relation.

By suitable actuation of the key lock 48, the lever 46 is returned to its open position as shown in FIG. 3 of the drawings when it is desired to remove the cable 16 from around the several objects. Such key operation moves lever 46 to its open position against the bias of torsion spring 50. When this occurs, the aforedescribed compression springs 38 and 40 return the cover 14 and guide members 24 and 26, as well as wedge-shaped elements 28 and 30 to their retracted positions. This, of course, releases the respective cable portions from being gripped by the elements 28 and 30. Withdrawing the cable 16 from the aforementioned passageways 42 and 44 thus releases or unlocks the objects retained thereby.

It is thus seen that the present invention provides a locking mechanism which is capable of securing together two or more objects. In this regard, it is contemplated that within the purview of this invention, three or four or more wedge-shaped elements could be provided for gripping cable sections or portions simultaneously to thereby provide three or four or more loops in the encircling cable.

Although I have shown and described certain specific embodiments of my invention, I am well aware that many modifications thereof are possible. The invention, therefore, is not to be restricted except insofar as is necessitated by the prior art and by the spirit of the appended claims.

I claim:

1. A locking mechanism for encircling and retaining two or more separate objects comprising in combination, a housing formed with two or more through passageways, a cable having one end anchored to said housing and being threadable through said passageways successively to form two or more cable loops for separately encircling the corresponding number of objects, and a releasable latch mechanism having two or more wedge-shaped elements which are rectilinearly moveable in the same direction into engagement with said cable for separately gripping said cable in said passageways.

2. A locking mechanism for encircling and retaining two or more separate objects according to claim 1 wherein said wedge-shaped elements are simultaneously moveable into gripping position from externally of said housing.

3. A locking mechanism for encircling and retaining two or more separate objects according to claim 2 wherein each of said passageways in said housing is formed with a pair of aligned passageway portions separated by a locking area wherein said wedge-shaped elements are moveable between said gripping position and a retracted position.

4. A locking mechanism for encircling and retaining two or more separate objects according to claim 3 wherein said locking area is formed with a wall having a surface formed generally complementally of said wedge-shaped elements to receive the respective cable portions as said elements are moved into gripping position.

5. A locking mechanism for encircling and retaining two or more separate objects according to claim 4 wherein said wall surface is laterally offset from the alignment of said passageway portions to enable said elements to firmly grip the cable thereat.

6. A locking mechanism for encircling and retaining two or more separate objects according to claim 5 wherein said latch mechanism further includes alignment means fixed relative to said elements for movement with said elements within said housing, said alignment means cooperating with means formed within said housing to control movement of said elements to and from gripping position.

7. A locking mechanism for encircling and retaining two or more separate objects according to claim 1 wherein said latch mechanism includes a lever mounted within said housing for effectively engaging said elements when in gripping positions.

8. A locking mechanism for encircling and retaining two or more separate objects according to claim 7 wherein said lever is spring biased toward engagement with a pin fixed to said elements, and key-operated means is provided for moving said lever to enable said elements to release said cable.

* * * * *